United States Patent [19]

Duggan et al.

[11] Patent Number: 4,811,520

[45] Date of Patent: Mar. 14, 1989

[54] SHOWER DOOR ASSEMBLY

[75] Inventors: John A. Duggan, Schaumburg; Robert P. Gombas, Hickory Hills, both of Ill.

[73] Assignee: Universal-Rundle Corporation, New Castle, Pa.

[21] Appl. No.: 231,666

[22] Filed: Aug. 11, 1988

Related U.S. Application Data

[63] Continuation of Ser. No. 937,361, Dec. 3, 1986, abandoned.

[51] Int. Cl.[4] ..... E05D 13/00

[52] U.S. Cl. ..... 49/409; 49/460

[58] Field of Search ..... 49/409, 410, 411, 412, 49/460; 4/607, 610, 612

[56] References Cited

U.S. PATENT DOCUMENTS

| | | | |
|---|---|---|---|
| 2,931,078 | 4/1960 | Beyrle | 49/460 |
| 3,075,702 | 1/1963 | Pappas | 49/460 X |
| 3,117,339 | 1/1964 | Vigna | 49/460 X |
| 3,648,411 | 3/1972 | Saunders et al. | 49/460 |
| 4,178,718 | 12/1979 | Laby | 49/411 |
| 4,512,045 | 4/1985 | Baus | 4/607 X |
| 4,520,608 | 6/1985 | Baus | 4/607 X |

*Primary Examiner*—Philip C. Kannan

*Attorney, Agent, or Firm*—Marshall, O'Toole, Gerstein, Murray & Bicknell

[57] ABSTRACT

An enclosure for a tub or shower comprising a header having first and second exterior faces with each face having a decorative configuration. Panel doors, each having an interchangeable towel rack or handle, are connected to said header. Each towel rack or handle has a decorative configurations which is the same as or corresponds with one of the decorative configurations on the header exteriors such that a towel rack or handle and a header exterior face have matching decorative configurations when viewed from either the inside or outside of the enclosure.

12 Claims, 2 Drawing Sheets

SHOWER DOOR ASSEMBLY

This application is a continuation of application Ser. No. 937,361, filed Dec. 3, 1986, now abandoned.

This invention relates to an enclosure used in conjunction with a shower or tub and more particularly to a sliding closure assembly having a header and panel doors in which the towel rack or handles on the panel door and the exterior faces of the header provide coordinated, interchangeable, ornamental or decorative facings.

BACKGROUND OF THE INVENTION

Enclosures for tubs and showers often include sliding panel enclosures which include one or more panel members. The panels are disposed within top and bottom headers with the panels often being suspended from and adapted to slide on rollers along a track disposed in the top header. The panel members are often constructed of tempered glass or plastic which serves as a water barrier and provides light transmission. The panels normally are enclosed in a metal or plastic frame and usually include a towel rack or handle disposed intermediate the panel. One such assembly is disclosed in U.S. Pat. No. 4,178,718. In some instances, one or more exterior faces of the header are provided with an ornamental or decorative configuration. In some instances, the header may include a scalloped ornamental exterior facing. Another decorative configuration comprises a grooved exterior face member which is adapted to receive insertable decorative trim strips which coordinate with the decor of the room. An example of a header member having ornamental configurations on the exterior face is shown in U.S. Pat. No. 4,178,718.

It has been found, however, that the towel racks or handles located on the panel members often are not compatible with the decorative configuration on the header particularly in applications which involve a sliding panel enclosure where a towel rack or handle is disposed on the inside face of one panel member and another towel rack or handle is disposed on the outside face of another panel member.

What is desired is to have an enclosure assembly in which a number of interchangeable, decorative schemes are available for a tub or shower enclosure. Further, it is desired that the decorative configuration be coordinated between the header and towel rack or handle members so that when one views either the exterior or interior of a tub or shower enclosure, the ornamental or decorative facing on the header is coordinated with or is the same as the facing on a towel rack or handle.

SUMMARY OF THE INVENTION

The present invention serves as a solution to the referenced problems. More specifically, the present invention serves to provide a tub or shower enclosure which utilizes one or more sliding panels in which each panel is normally provided with a handle or towel rack. The panel members are suspended from and adapted to travel on rollers along a track disposed in a top header. The header includes a pair of exterior faces, each of which is ornamentally configured. The towel rack or handle also includes an ornamental exterior which coordinates with or is the same as one of the two ornamental header exterior faces.

In the instance where two panel members are utilized, the rack or handle of one panel will have the same or coordinated ornamental decoration as the ornamental configuration on one header face exterior whereas the other panel includes a towel holder or rack or handle which includes the same or coordinated ornamental configuration as the ornamental configuration on the remaining header exterior.

The towel racks or handles are removably fastened to the panels by suitable, conventional fastening means such as screws and the racks or handles are interchangeable with one another. The header member is adapted to be interchangeably positioned in the assembly so that the desired ornamental header exterior is facing either outwardly or inwardly of the enclosure.

In assembly, the header is installed with the desired ornamental exterior facing outwardly. The towel rack or handle located on the outer wall of one panel member has the same or coordinated ornamental face as that on the outward exterior face of the installed header member. A second panel member has a towel rack or handle disposed on the inner panel wall. An ornamental configuration which is the same as or coordinated with the ornamental configuration on the remaining inwardly facing header exterior is located on the second panel member.

When the tub or shower enclosure is viewed from outside the enclosure, the ornamental configuration on the header and towel rack or handle will be the same or coordinated with one another. When viewed from inside the enclosure, the ornamental configuration on the remaining header exterior and inner towel rack or handle are the same or coordinated with each other. A plurality of matching or coordinated header and panel decorative configurations are available for a particular tub or shower enclosure because the header can be rotated 180° to reorient the header exterior faces and the panel towel racks and handles are interchangeable.

It also has been found that by providing a header or panel member having a concavo-shaped and flanged face, a decorative trim strip, when disposed on the header face or panel will fit in the flanges.

BRIEF DESCRIPTION OF THE DRAWINGS

The invention may be best understood by reference to the following description in conjunction with the accompanying drawings in which like reference numerals identify like elements in the several figures and in which.

DETAILED DESCRIPTION

Figure 1:
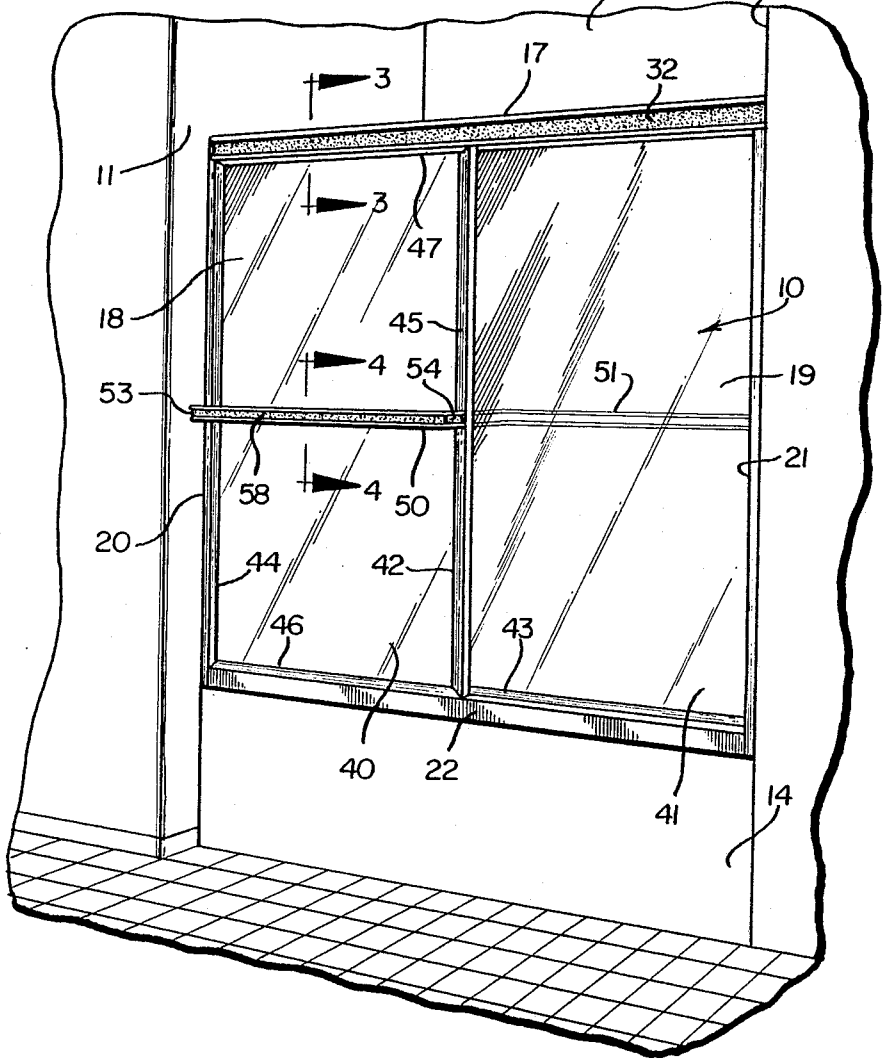
FIG. 1 shows a fragmentary perspective view of a tub or shower enclosure with slidable panel members, each member having a towel rack or handle fastened to the panel and the ornamental configuration on the exterior face of the top header being the same or coordinated with the ornamental configuration on the outer panel member rack or handle.

Referring to the drawings, FIG. 1 shows a tub or shower enclosure 10 located between vertical walls 11, 12, 13 and above a conventional bath tub 14. A plurality of roller assemblies 15, disposed in tracks 28 (FIG. 3), engage a horizontal top frame header 17 to support door panels 18, 19, panel 19 being the inner door panel. Side frame members 20, 21 are secured to vertical walls 11, 13 respectively and connect to a horizontal bottom track or header 22 secured to the upper tub wall surface in a conventional manner such as by water-proof adhesive.

Figure 3:
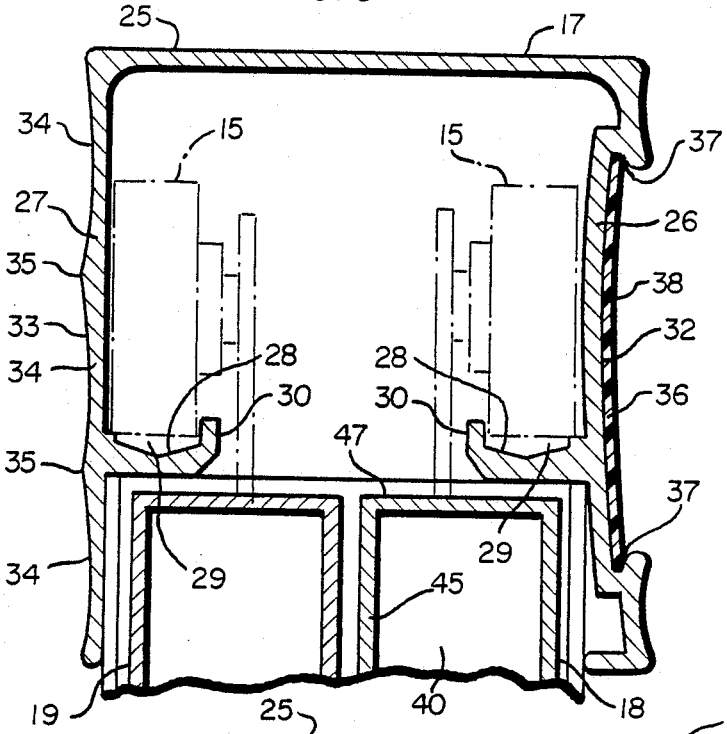
FIG. 3 shows a fragmentary section view taken along lines 3—3 of the header in FIG. 1.
Figure 5:
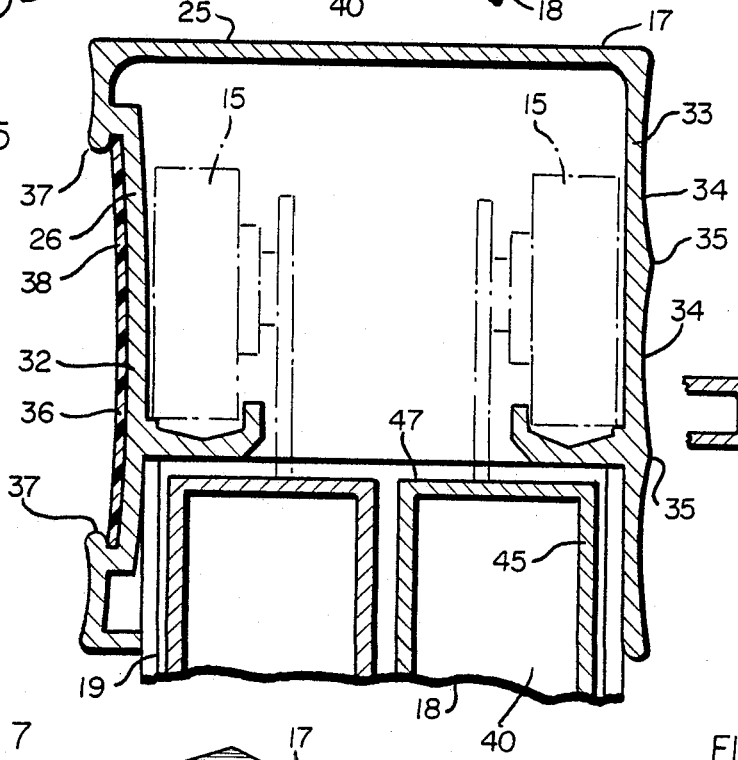
FIG. 5 shows a fragmentary section view taken along lines 5—5 of the header in FIG. 2.
Figure 9:
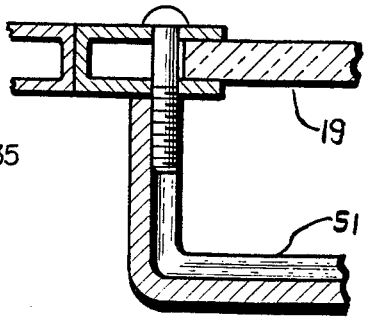
Figure 7:
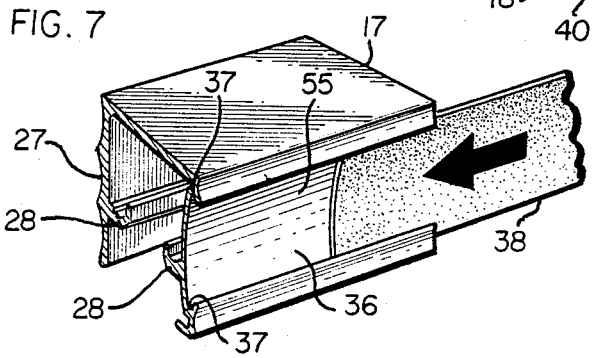
FIG. 7 shows a fragmentary perspective view of a decorative trim member being disposed in the flanged, concavo-shaped exterior face of the header member.

Header 17 is supported between walls 11 and 13 and, as seen in FIGS. 3 and 5, has an inverted U shape. Base 25 extends between two downwardly depending flanges 26, 27, flange 26 comprising the exterior header face member shown in FIG. 1. Each flange has an inwardly protruding, longitudinally extending track 28 which includes track rail 29 and a flanged track lip 30.

Header flanges 26, 27 each have an exterior face 32, 33 which is ornamentally configured. As seen in FIG. 3, flange 27 has an exterior face 33 which is scalloped to provide inward, shallow concavities 34 terminating in spaced ridges 35.

Flange 26 has an exterior face which is configured to include a concavo-shaped surface 36 and grooves 37 spaced vertically from each other on flange 26. A decorative trim strip 38 is adapted to be inserted in grooves 37 whereby trim strip 38 is retained in flange 26. Header flanges 26, 27 of header 17 are adapted to engage and be connected by conventional fastening means to the side panels 20, 21 thereby retaining header 17 in place while panels 18, 19 are adapted to slide longitudinally along header 17 and bottom track 22.

Panel members 18, 19 each include a tempered glass or plastic member 40, 41 which is enclosed in a metal or plastic support frame 42, 43. FIG. 1 shows support frame 42 which comprises vertical support members 44, 45, bottom support member 46 and top support member 47. Support frame 43 has a similar construction to that of panel member support frame 42.

Panels 18, 19 each include a towel rack or handle 50, 51 which is screwed or otherwise fastened in a conventional manner to the side walls of a panel support frame. Each rack or handle member is U shaped and includes a base 52 curved at its ends to form depending legs 53, 54.

Figure 4:
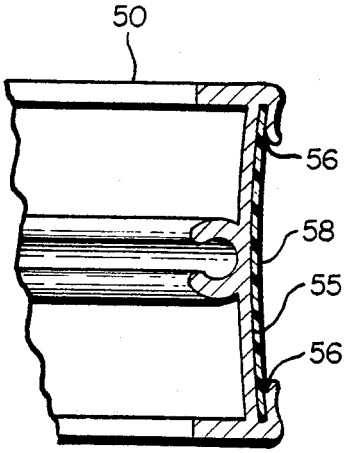
FIG. 4 shows a fragmentary section view taken along lines 4—4 of the towel rack or handle in FIG. 1.
Figure 6:
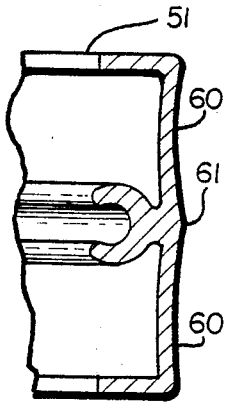
FIG. 6 shows a fragmentary section view taken along lines 6—6 of the towel rack or handle in FIG. 2.
Figure 8:
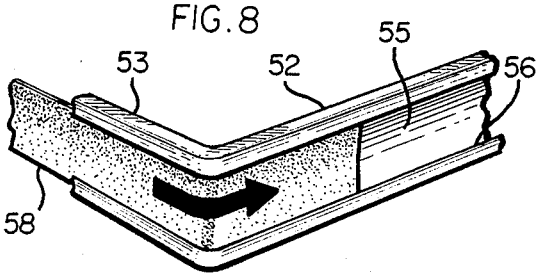
FIG. 8 shows a fragmentary perspective view of a decorative trim member being disposed in and along the side and front portions of a flanged, concavo-shaped face of a towel rack or handle; and, FIG. 9 is a section view taken along lines 9—9 in FIG. 2 showing a portion of a handle or towel rack removably fastened by screw means to a panel member.

Referring to FIGS. 4 and 8, the base and legs of member 50 include a continuous concavo-shaped surface 55 and continuous grooves 56 spaced vertically from one another. A decorative trim strip 58 is adapted to be inserted in continuous grooves 56 where it is retained in member 50. The decorative configuration of towel rack or handle 50 is the same or coordinated with the configuration on the exterior face 32 of header 17. Instead of having the same color trim strip 38 and 58 in header 17 and towel rack or handle 50, the colors of the trim strips may differ so long as they coordinate to the desired decor of the room. It is in this sense that the decorative configurations on the exterior faces of a header and panel are said to be coordinated.

Panel member 51 has a similar structure to that of panel member 50 with the exception that the panel member base and legs have the scalloped decorative configuration as the exterior header face 33 which include concavities 60 terminating in ridge 61.

When one views enclosure 10 from outside the tub or shower, the exterior face 32 of header 17 and the towel rack or handle 50 will have the same or coordinated decorative configuration utilizing insertable colored trim strips. Viewing the enclosure from inside the tub or shower, the exterior header face 32 and the rack or handle member 51 will employ the same coordinated decorative configurations, i.e., a scalloped configuration.

Figure 2:
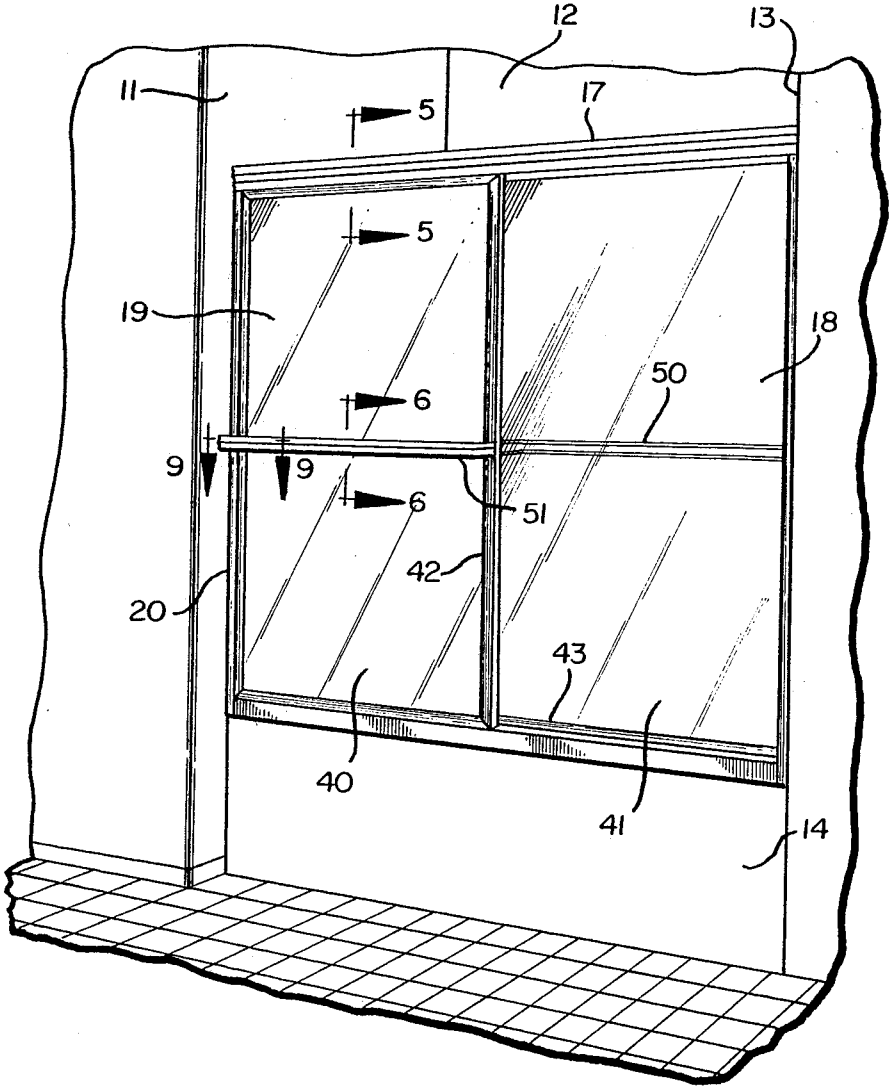
FIG. 2 shows a fragmentary perspective view similar to FIG. 1 except the header member has been rotated 180° from the header position shown in FIG. 1 and the paneltowel racks or handles have been interchanged so that the exterior face of the header and outer towel rack have the same or coordinated ornamental configuration which is from the ornamental configuration shown FIG. 1.

If it is desired to reverse the decorative configuration, one need only disassemble the enclosure and rotate the top header 180° so that the scalloped exterior face 33 of header 17 faces outwardly and the decorative trim strip exterior face 32 faces inwardly of the enclosure. Towel racks or handles 50, 51 are disassembled and interchanged so that rack 50 in FIG. 1 is moved to the rack or handle location shown in FIG. 2 and rack or handle member 51 in FIG. 1 is moved to the location shown in FIG. 2, the effect being, as shown in FIG. 2, that the scalloped, decorative configuration for both top header 17 and towel rack 51 is located on the outside of the enclosure whereas the trim insert decorative configuration is inside located inside the enclosure.

Utilization of the replaceable header and towel racks or handles each having a decorative configuration provides several matching or coordinated decorative schemes for a tub or shower enclosure whereby the header and towel racks or handles have matching decorative motifs when the enclosure is viewed either from inside or outside the enclosure.

The utilization of the grooves 37 and 56 to retain the decorative trim strip serves to retain the trim strip in the proper position.

The foregoing detailed description has been given for clearness of understanding only and no unnecessary limitations should be understood therefrom as modifications will be obvious to persons of ordinary skill in the art.

I claim:

1. An enclosure for a tub or shower comprising a header member having a first exterior face and a second exterior face;

at least two panel members connected to said header and at least one of said panel members being adapted to slide along said header relative to said other panel member;

at least one of said panel members having a removable panel means for serving as a handle or a holder;

said first exterior face on said header having a first decorative configuration disposed thereon and said second exterior face having a second decorative configuration disposed thereon; and, said removable panel means having a decorative configuration that is the same as or corresponds with said first or second decorative configuration on either of said first or second exterior faces on said header.

2. An enclosure for a tube or shower comprising a header member having a first exterior face and a second exterior face;

at least two panel members connected to said header and at least one of said panel members being adapted to slide along said header relative to said other panel member;

said first exterior face on said header having a first decorative configuration disposed thereon and said second exterior face having a second decorative configuration disposed thereon;

each panel member having a panel handle or holder means with one of said panel means having the same or corresponding decorative configuration as the first decorative configuration on said first exterior header face and said remaining panel means having a panel decorative configuration which is the same as or corresponding with the second decorative configuration on said second exterior header face.

3. An enclosure in accordance with claim 2 wherein said first decorative configuration comprises a replaceable decorative trim strip.

4. An enclosure in accordance with claim 3 wherein said second decorative configuration is scalloped.

5. An enclosure in accordance with claim 3 wherein one of said exterior header faces and one of said panel means each comprise a concavo-shaped surface, a pair of space grooves spaced vertically on said surface and a replaceable decorative trim strip disposed within said grooves.

6. An enclosure in accordance with claim 2 wherein said first and second panel means are interchangable with each other and said header is adapted to be rotated 180° in assembly.

7. An enclosure comprising a top header member having a first exterior face and a second exterior face;

a pair of panel members connected to said header, at least one of said panel members being slidable along the length of said header;

each of said panel members having a means for serving as a holder or handle removably connected to said panel member and positioned intermediate said member;

said first exterior header face having a first decorative configuration disposed thereon and said remaining exterior header face having a second decorative configuration disposed thereon;

said first panel means having a decorative configuration which is the same as or corresponding to said first decorative configuration on said header;

said second panel means having a decorative configuration which is the same as or corresponding to said second decorative configuration on said header;

said first decorative face on said header and said like or corresponding decorative configuration on said first panel means facing outward upon enclosure installation and said second decorative configuration on said header and said second decorative configuration on said second panel means facing inwardly upon enclosure installation.

8. An enclosure in accordance with claim 7 wherein said panel means on said first and second panel members are interchangeable with one another.

9. An enclosure in accordance with claim 8 wherein said header is adapted to be rotated 180° in assembly whereby said first and second decorative configurations are reversed in the enclosure.

10. An enclosure in accordance with claim 9 wherein said first decorative configuration on said header and said panel means comprises a replaceable decorative trim strip.

11. An enclosure in accordance with claim 10 wherein said second decorative configuration on said header and said remaining panel means is scalloped.

12. An enclosure in accordance with claim 10 wherein each of said first decorative configurations on said header and said panel means further includes a concavo-shaped surface, a pair of grooves spaced vertically on said concavo-shaped surface and a replaceable decorative trim strip disposed within said grooves.

* * * * *